US006727051B2

(12) United States Patent
Haye et al.

(10) Patent No.: US 6,727,051 B2
(45) Date of Patent: Apr. 27, 2004

(54) ODORLESS PHOTOGRAPHIC BLEACH-FIXING COMPOSITION AND METHOD OF USE

(75) Inventors: Shirleyanne E. Haye, Rochester, NY (US); Janet M. Huston, Webster, NY (US); Eric R. Schmittou, Rochester, NY (US); Therese M. Feller, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/400,607

(22) Filed: Mar. 27, 2003

(65) Prior Publication Data

US 2003/0190560 A1 Oct. 9, 2003

Related U.S. Application Data

(63) Continuation of application No. 10/012,611, filed on Oct. 30, 2001.

(51) Int. Cl.[7] ..... G03C 7/42

(52) U.S. Cl. ..... 430/460

(58) Field of Search ..... 430/460

(56) References Cited

U.S. PATENT DOCUMENTS

| | | | | | |
|---|---|---|---|---|---|
| 5,250,401 | A | | 10/1993 | Okada et al. | 430/393 |
| 5,352,568 | A | | 10/1994 | Kuse et al. | 430/393 |
| 5,534,395 | A | * | 7/1996 | Kamada et al. | 430/393 |
| 5,573,895 | A | * | 11/1996 | Komatsu et al. | 430/398 |
| 5,783,376 | A | * | 7/1998 | Gordon et al. | 430/460 |

FOREIGN PATENT DOCUMENTS

| | | |
|---|---|---|
| EP | 0 334 317 A2 | 9/1989 |
| EP | 0 595 102 A1 | 5/1994 |
| WO | WO 01/50197 A1 | 7/2001 |

* cited by examiner

*Primary Examiner*—Hoa Van Le
(74) *Attorney, Agent, or Firm*—J. Lanny Tucker

(57) ABSTRACT

A photographic bleach-fixing composition has reduced odor and acceptable storage stability. It comprises an iron-ligand complex bleaching agent, thiosulfate fixing agent, sulfite ions, and a phthalic acid or salt thereof. This bleach-fixing composition can be used in various photographic processing protocols to provide color images from color photographic silver halide materials.

22 Claims, No Drawings

ODORLESS PHOTOGRAPHIC BLEACH-FIXING COMPOSITION AND METHOD OF USE

This application is a continuation of application Ser. No. 10/012,611 filed Oct. 30, 2001.

FIELD OF THE INVENTION

This invention relates in general to photography. More particularly, it relates to a photographic bleach-fixing composition, and to a method of processing color photographic silver halide elements using that composition.

BACKGROUND OF THE INVENTION

The basic image-forming process of color silver halide photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver ion is generally removed by dissolving it in a silver solvent, commonly known as a fixing agent.

In some photochemical processes, bleaching and fixing are combined in a bleach-fixing step using a composition that includes both a bleaching agent to oxidize metallic silver and a fixing agent to dissolve the remaining silver ion, as described for example in U.S. Pat. No. 4,033,771 (Borton et al.).

The most common bleaching agents for color photographic processing are complexes of ferric [Fe(III)] ion and various organic chelating ligands (such as aminopolycarboxylic acids), of which there are hundreds of possibilities, all with varying photographic bleaching abilities and biodegradability. Common organic chelating ligands used as part of bleaching agents for photographic color film processing include ethylenediaminetetraacetic acid (EDTA), 1,3-propylenediaminetetraacetic acid (PDTA) and nitrilotriacetic acid (NTA). Common color paper bleaching is often carried out using EDTA as a chelating ligand.

A wide variety of fixing agents and silver solvents are known, as described for example in U.S. Pat. No. 5,633,124 (Schmittou et al.) and publications noted therein. Thiosulfate salts are generally preferred as fixing agents because they are inexpensive, highly water soluble, non-toxic, non-odorous, and stable over a wide pH range. Thus, fixing is usually accomplished using a thiosulfate fixing agent that diffuses into the element, and forms silver thiosulfate complex that diffuses out of the element. In large photofinishing labs, the elements are usually immersed in a fixing solution for from 4 to 6 minutes. In small minilabs, the fixing time is shorter, that is from 90 to 120 seconds.

As pointed out in U.S. Pat. No. 5,055,382 (Long et al.), when photographic materials are processed in bleach-fixing steps, the bleach-fixing composition is generally formulated from two or more "parts", each "part" or solution typically containing one or more (but not all) of the photochemicals necessary for the processing reactions. For example, one "part" usually contains the conventional ferric bleaching agent, and another "part" usually contains a thiosulfate fixing agent(s) and a sulfite preservative. These "parts" are sometimes provided together in a photochemical processing "kit". If all of the chemicals are formulated in a single solution, storage stability is reduced or nonexistent since unwanted chemical interactions among components are inevitable. For example, ferric bleaching agents, sulfite preservatives, and thiosulfate fixing agents are inherently reactive, thereby degrading solution effectiveness and storage stability. Thus, most common bleach-fixing solutions are provided from "two parts", each part containing at least one essential reactive component.

Throughout the photographic industry, there is a desire to provide "concentrated" photoprocessing chemicals to reduce handling, transportation and storage costs. Single-part bleach-fixing compositions are also desired for such reasons.

Thus, there is a need for a highly effective photographic bleach-fixing composition that has reduced odor and improved keeping stability.

SUMMARY OF THE INVENTION

This invention provides a photographic bleach-fixing composition that has a pH of from about 2 to about 9 when in aqueous form, and comprises:

at least 0.01 mol/l of a ferric-ligand bleaching agent, at least 0.05 mol/l of a thiosulfate fixing agent, at least 0.01 mol/l of sulfite ions, and at least 0.025 mol/l of a phthalic acid or a salt thereof.

This invention also provides a method for providing a color photographic image comprising contacting a color developed color photographic silver halide material with the photographic bleach-fixing composition described above.

In another embodiment, a method for providing a color photographic image comprises:

A) color developing an imagewise exposed color photographic silver halide material in a predetermined volume of an aqueous color developing composition in a processing chamber, and B) without removing the predetermined volume of the aqueous color developing composition or the color photographic silver halide material from the processing chamber, adding a predetermined volume of the photographic bleach-fixing composition described above to the processing chamber to provide a combined aqueous color development/bleach/fixing composition, and bleaching and fixing the color photographic silver halide material.

The photographic bleach-fixing composition of this invention has been shown to exhibit acceptable keeping stability and reduced odor without diminishing its photographic processing properties. These advantages are achieved by using a phthalic acid or a salt thereof in the bleach-fixing composition.

DETAILED DESCRIPTION OF THE INVENTION

Photographic bleach-fixing is carried out in one or more steps using one or more photographic bleaching agents that are Fe(III) complexes of carboxylic acids as a first essential component. Preferred carboxylic acid ligands include aminopolycarboxylic acid or polyaminopolycarboxylic acid chelating ligands. At least one of those steps is carried out using the bleach-fixing composition of this invention.

Useful iron-ligand complexes comprise one or more polycarboxylic acid chelating ligands. Particularly useful chelating ligands include conventional polyaminopolycarboxylic acids including ethylenediaminetetraacetic acid and others described in *Research Disclosure*, publication 38957, pages 592–639 (September 1996), U.S. Pat. No. 5,334,491 (Foster et al.), U.S. Pat. No. 5,582,958 (Buchanan et al.), and U.S. Pat. No. 5,753,423 (Buongiorne et al.). *Research Disclosure* is a publication of Kenneth Mason Publications Ltd., Dudley House, 12 North Street, Emsworth, Hampshire PO10 7DQ England. This reference will be referred to hereinafter as "*Research Disclosure*." There are hundreds of possible chelating ligands that are known in the art, the most common ones being ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA) and hydroxyethylethylenediaminetriacetic acid (HEDTA).

Biodegradable chelating ligands are particularly desirable in order to minimize the impact on the environment from discharged photoprocessing solutions.

One particularly useful biodegradable chelating ligand is ethylenediaminedisuccinic acid (EDDS) as described in U.S. Pat. No. 5,679,501 (Seki et al.) and EP-0 532,001 B (Kuse et al.). All isomers of EDDS are useful, including the [S,S] isomer, and the isomers can be used singly or in mixtures. The [S,S] isomer is most preferred in the iron-EDDS complexes. Other useful disuccinic acid chelating ligands are described in U.S. Pat. No. 5,691,120 (Wilson et al.).

Aminomonosuccinic acids (or salts thereof) are chelating ligands having at least one nitrogen atom to which a succinic acid (or salt) group is attached. These chelating ligands are also useful in iron complexes. U.S. Pat. No. 5,652,085 (Stickland et al.) also provides more details about such chelating ligands, particularly the polyamino monosuccinic acids. Ethylenediamine monosuccinic acid (EDMS) is preferred in this class of chelating ligands.

Other classes of biodegradable aminopolycarboxylic acid or polyaminopolycarboxylic acid chelating ligands that can be used to form biodegradable iron complexes include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl, and t-butyl) as described in EP-A-0 532,003 (Kuse et al.). Particularly useful alkyliminodiacetic acids are methyliminodiacetic acid (MIDA) and ethyliminodiacetic acid (EIDA), and MIDA is the most preferred.

All chelating ligands useful in this invention can be present in the free acid form or as alkali metal (for example, sodium and potassium) or ammonium salts, or as mixtures thereof.

Still other biodegradable chelating ligands can be represented by the following Structure I:

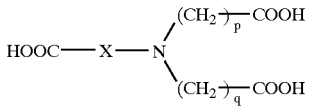

I wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

The iron-ligand complexes useful in this invention can be binary complexes (meaning iron is complexed to one or more molecules of a single chelating ligand) or ternary complexes in which iron is complexed to molecules of two distinct chelating ligands similar to iron complexes described for example in U.S. Pat. No. 5,670,305 (Gordon et al.) and U.S. Pat. No. 5,582,958 (noted above). A mixture of multiple binary or ternary iron complexes also can be present in the compositions.

Still other useful biodegradable iron chelating ligands include but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid, and tartaric acid.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

Generally, the one or more ferric-ligand complexes are present in the bleach-fixing compositions in an amount of at least 0.01 mol/l, up to 2 mol/l, and preferably in an amount of from about 0.05 to about 0.75 mol/l.

Ferric ions in the bleaching agents can be provided from any conventional source including iron salts and iron oxides such as magnetite.

The iron salts used to provide bleaching compounds in the practice of this invention are generally ferric salts that provide a suitable amount of ferric ions for complexation with the chelating ligands defined above. Useful ferric salts include, but are not limited to, ferric ammonium sulfate, ferric sodium sulfate, ferric chloride, ferric nitrate, ferric bromide, ferric sulfate, ferric acetate, ferric oxalate, and ferric gluconate. Ferric nitrate is a preferred ferric salt. These salts can be provided in any suitable form, including various hydrated forms where they exist, and are available from a number of commercial sources.

Ferric ions can also be provided as ferrous ions that are oxidized at an appropriate time prior to or during use in an appropriate way as described in copending U.S. Ser. No. 09/723,794 (filed Nov. 28, 2000 by Vincent et al.).

It is not necessary that the ferric ion and the chelating ligand(s) be present in the bleach-fixing compositions in stoichiometric proportions. It is preferred, however, that the molar ratio of the total chelating ligands to ferric ion be from about 1:1 to about 5:1. In a more preferred embodiment, the ratio is about 1:1 to about 2.5:1 moles of total chelating ligands per mole of ferric ion.

Generally speaking, ferric ions are present in the bleach-fixing precursor compositions in an amount of at least 0.01 mol/l, and preferably in an amount of at least 0.05 mol/l.

Chloride, bromide or iodide ions, or mixtures of halides are optionally present in the bleach-fixing compositions. Such ions are provided in the form of water-soluble salts including ammonium, alkali metal and alkaline earth metal salts. The preferred salts are sodium, potassium and ammonium salts.

It is desired that ammonium ions are the predominant ions in the bleach-fixing compositions. That is, ammonium ions comprise at least 50 mol % of the total cations in the compositions.

The photographic bleach-fixing composition of this invention can be packaged and transported as a dry or liquid formulation, working strength solution, or as a single-part concentrated composition. It can be used as a replenisher as well as the initial tank working solution. Preferably, the photographic bleach-fixing composition is provided in aqueous form and has a pH of from about 2 to about 9. A preferred pH is in the range of from about 4.5 to about 8.

A second essential component in the photographic bleach-fixing composition comprises one or more thiosulfate fixing agents. The thiosulfate can be any of sodium thiosulfate, potassium thiosulfate, ammonium thiosulfate, lithium thiosulfate, calcium thiosulfate, or magnesium thiosulfate, or mixtures thereof such that a desired concentration of thiosulfate ion is provided. Preferably, ammonium thiosulfate or sodium thiosulfate (or a mixture thereof) is used. For rapid fixing, ammonium thiosulfate is preferably used.

Optionally, one or more thiocyanate fixing agents can also be present as a fixing agent especially for more rapid silver removal. If present, it can be provided as sodium thiocyanate, potassium thiocyanate, or ammonium thiocyanate, or mixtures thereof Preferably ammonium or sodium thiocyanate (or mixtures thereof) is used. The thiosulfates and thiocyanates can be obtained from a number of commercial sources or prepared using conventional starting materials and synthetic procedures.

A third essential component of the photographic bleach-fixing composition is a source (or mixture of sources) of sulfite ions. Useful salts that provide sulfite ions include but are not limited to sodium sulfite, potassium sulfite, ammonium sulfite, sodium bisulfite, sodium metabisulfite, potassium metabisulfite, and mixtures of such salts such that the desired sulfite concentration is obtained.

The fourth essential component of the photographic bleach-fixing composition is a phthalic acid or a salt thereof. By "a phthalic acid", we mean to include substituted phthalic acids. Preferred salts of phthalic acid include hydrogen phthalates such as sodium hydrogen phthalate, potassium hydrogen phthalate, ammonium hydrogen phthalate, lithium hydrogen phthalate, sodium phthalate, and potassium phthalate. Potassium hydrogen phthalate and sodium hydrogen phthalate are preferred. Mixtures of two or more of these compounds can also be used.

The concentrations (general and preferred) of the four essential components of the photographic bleach-fixing composition of this invention are listed in TABLE I below wherein all of the ranges of concentrations are considered to be approximate (that is "about" at the range end points).

TABLE I

| COMPONENT | GENERAL AMOUNT (mol/l) | PREFERRED AMOUNT (mol/l) |
|---|---|---|
| Fe(III)-ligand complex | 0.01 to 2 | 0.05 to 0.75 |
| Thiosulfate fixing agent | 0.05 to 5 | 0.1 to 4 |
| Sulfite ions | 0.01 to 1 | 0.05 to 0.5 |
| Phthalic acid or salt thereof | 0.025 to 1 | 0.025 to 0.75 |

If a thiocyanate fixing agent is also present in the photographic bleach-fixing composition, it is generally present in an amount of from about 0.05 to about 5 mol/l.

Optional addenda that can be present in the photographic bleach-fixing composition if desired are materials that do not materially affect its photographic bleaching and fixing functions. Such materials include, but are not limited to, biocides, alkyl or arylsulfinic acids or their salts, halides (such as bromide ions, chloride ions, or iodide ions), photographic hardeners, metal ion sequestering agents (such as polycarboxylic acids, polyaminopolycarboxylic acids, and polyphosphonic acids), buffers (such as acetic acid or succinic acid), bleaching accelerators, fixing accelerators, and other materials readily apparent to one skilled in the photographic art. These and other optional materials can be present in conventional amounts [for example as described in U.S. Pat. No. 5,633,124 (noted above)].

The essential and optional components of the photographic bleach-fixing compositions of this invention can be mixed together in any suitable order as would be known in the art, and stored for a time or used immediately as liquid or solid formulations. They can be formulated in aqueous concentrates such that dilution up to 10 times is required before or during use. Alternatively, they can be formulated as solid compositions (tablets, pellets, powders or granules) and added to a processing tank with appropriate amounts of water for use.

During photographic processing, conventional procedures can be used for replenishment of the various processing solutions, including the photographic bleach-fixing solution. Preferably, the rate of bleach-fixing solution replenishment is not more than 3000 ml/m$^2$, and preferably from about 250 to about 1500 ml/m$^2$ of processed photographic material. The processing equipment can be any suitable processor having one or more processing tanks or vessels, including minilab processors and larger scale processors. The bleach-fixing step can be carried out in one or more tanks or stages arranged in concurrent or countercurrent flow.

The present invention can be used advantageously with any of the known methods of applying photographic bleach-fixing compositions to photographic materials. These methods include, but are not limited to, immersing the material into an aqueous bleach-fixing composition (with or without agitation or circulation), bringing the material into contact with a web or drum surface that is wet with the bleach-fixing composition, laminating the material with a cover sheet or web in such a way that the fixing composition is brought into contact with the material, or applying the bleach-fixing composition to the material by high velocity jet or spray.

The bleach-fixing step can be generally carried out at a temperature of from about 20 to about 65° C. (preferably from about 30 to about 60° C.). The time of processing during this step is generally up to 600 seconds and preferably at least 10 and up to 400 seconds (more preferably from about 10 to about 240 seconds).

The other processing steps desired to provide color images can be similarly rapid or conventional in time and conditions. Preferably the other processing steps, such as color development, bleaching, and/or stabilizing (or rinsing), are likewise shorter than conventional times. For example, color development can be carried out for from about 12 to about 360 seconds, an optional bleaching step for from about 12 seconds to about 8 minutes, and stabilizing (or rinsing) for from about 15 to about 240 seconds in various processing protocols. The bleach-fixing step can be carried out more than once in some processing methods. The processing methods can have any of a wide number of arrangements of steps, as described for example in U.S. Pat. No. 5,633,124 (noted above) that is incorporated herein by reference.

In rapid processing methods, the total processing time for color negative films, can be up to 360 seconds (preferably from about 60 to about 250 seconds), and the total processing time for color papers can be up to 100 seconds (preferably from about 40 to about 100 seconds).

The present invention can therefore be used to process silver halide materials of various types including color papers (for example using Process RA-4), color motion picture films and prints (for example using Process ECP, Process ECN and Process VNF-1), and color negative films (for example using Process C-41) or color reversal films (for example using Process E-6). The various processing sequences, conditions and solutions for these processing methods are well known in the art.

Preferably, the photographic bleach-fixing composition of this invention is used in a novel rapid processing protocol that is identified herein as a "merged solution" processing method. This method generally includes, in order, color development and bleach-fixing, and optionally rinsing or stabilizing.

For example, a color photographic image can be provided by the following steps:

A) color developing an imagewise exposed color photographic silver halide material in a predetermined volume of an aqueous color developing composition in a processing chamber, and B) without removing the predetermined volume of the aqueous color developing composition or the color photographic silver halide material from the processing chamber, adding a predetermined volume of the photographic bleach-fixing composition of this invention to processing chamber to provide a combined aqueous color development/bleach/fixing composition, and bleaching and fixing the color photographic silver halide material.

In addition, after step B, the color photographic silver halide material or combined color development/bleach/fixing composition can be removed from the processing chamber and the material further processed with one or more separate processing compositions, such as a photographic stabilizing or rinsing composition, in the same or different processing chamber.

There can be additional processing steps between steps A and B (such as use of a washing or "stop" solution). It may be particularly useful to include an acidic "stop" solution or "stop-fixer" solution between steps A and B. Solutions added between steps A and B will necessarily be included in the final solutions that can be discarded or regenerated in any suitable manner. Alternatively, solutions added after step B can also be included in the final solutions of the method. In other words, steps carried out after step B can be conventional processing steps or additional "merged solution" processing steps.

The volumes of the various processing compositions used in the methods of this invention will vary depending upon the type of color photographic material being processed and the particular processing protocol used (for example, from large tank volumes to "minilab" volumes).

When the "merged solution" process is used, for example, to process color negative film, the predetermined volume of color developing composition introduced into the processing chamber is generally from about 50 to 2850 ml/m$^2$ and preferably from about 140 to about 1170 ml/m$^2$, of surface area of processed color photographic silver halide material. The predetermined volume of bleach-fixing composition introduced into the processing chamber may be sufficient to provide an additional volume of from about 6 to about 4000 ml/m$^2$ and preferably from about 20 to about 1600 ml/m$^2$, per surface area of processed color photographic silver halide material. Intermediate (for example washes, "stop", or "stop-fixer" solutions) or additional processing compositions (such as a bleaching, rinsing, or stabilizing composition) may be introduced into the processing chamber to each provide an additional volume of from about 6 to about 2000 ml/m$^2$ and preferably from about 20 to about 800 ml/m$^2$, of surface area of processed color photographic silver halide material.

For processing color papers using the "merged solution" processing method, the predetermined volumes of color developing composition introduced into the processing chamber may be generally from about 30 to about 400 ml/m$^2$ and preferably from about 40 to about 150 ml/m$^2$. The bleach-fixing composition can be then introduced into the processing chamber sufficient to provide an additional volume of from about 1 to about 450 ml/m$^2$ and preferably from about 10 to about 200 ml/m$^2$.

Thus, the volumes of processing solutions can be large like those used in the more conventional Process C-41 processing methods, or small like those generally used in "minilabs" or "SM" processors.

The one or more processing steps in this "merged solution" processing method can be carried out at the same or different temperatures generally within the range of from about 20 to about 65° C., and preferably at from about 30 to about 60° C.

In the "merged solution" processing method, step A is generally carried out for at least 15 seconds, and preferably for at least 25 seconds, and up to 195 seconds for color negative films and color papers, and up to 360 seconds for color reversal films.

If a "stop" or "stop-fixer" solution is used between steps A and B, this intermediate step is generally carried out for at least 5 seconds, preferably 10 seconds, and up to 60 seconds.

Step B is then carried out for at least 5 seconds, and preferably for at least 10 seconds, and up to 240 seconds for color negative films, up to 90 seconds for color papers, and up to 360 seconds for color reversal films.

In the "merged solution" processing method, the essential steps are carried out in the same processing chamber that can be of suitable size and shape to accommodate the processed materials and the various volumes of processing compositions that are added together throughout the various processing steps. The larger the volume of fluids added and the more steps used, the larger the processing chamber will likely be. In preferred embodiments, the volumes of each processing composition is small so that the total volume of the combined solutions at the end of the processing method is easily discarded. In such instances, the processing method can be considered a "single-use" processing method.

One suitable processing apparatus that can be used to carry out the "merged solution" processing method is described in more detail in copending and commonly assigned U.S. Ser. No. 09/920,495 (filed on Aug. 1, 2001 by Twist et al.).

Thus, in one embodiment of the "merged solution" processing method of this invention, a suitable processing chamber is loaded with an imagewise exposed color photographic material to be processed, and a metered (predetermined) amount of color developing composition is introduced into the chamber. Color development is then allowed to proceed for a suitable time. Without removing the color photographic material or color developing composition from the processing chamber, a metered (predetermined) amount of the bleach-fixing composition of this invention is then introduced into the processing chamber to provide a combined color developing/bleach/fixing composition. Bleaching and fixing are then carried out for a suitable time. An intermediate "stop" or "stop-fixer" solution can be introduced prior to addition of the bleach-fixing composition.

In each of these processing steps, each solution is spread uniformly over the entire surface of the color photographic material to provide uniform processing. Each processing step is preferably carried out in a high agitation, batch processor that is used to process one color photographic material at a time with small volumes.

Further details of these processing embodiments are provided in copending and commonly assigned U.S. Ser. No.

10/012,673 filed on Oct. 30, 2001 by Twist and entitled "Processing Photographic Material", now U.S. Pat. No. 6,620,578.

The emulsions and other components, and structure of color photographic materials used in this invention and the various procedures for manufacturing them are well known and described in considerable publications, including, for example, *Research Disclosure*, publication 38957, pages 592–639 (September 1996), and *Research Disclosure*, Volume 370, February 1995, and hundreds of references noted therein. Research Disclosure is a publication of Kenneth Mason Publications Ltd., Dudley House, 12 North Street, Emsworth, Hampshire PO10 7DQ England (also available from Emsworth Design Inc., New York, N.Y. 10011). This reference will be referred to hereinafter as "Research Disclosure". More details about such materials are provided herein below. In particular, the invention can be practiced with photographic films containing any of many varied types of silver halide crystal morphology, sensitizers, color couplers, and addenda known in the art, as described in the noted Research Disclosure publication and the many publications noted therein. The films can have one or more layers, at least one of which is a silver halide emulsion layer that is sensitive to electromagnetic radiation, disposed on a suitable film support (typically a polymeric material).

The processed color negative films may have a magnetic recording layer, or stripe, on the support opposite the silver halide emulsion layer(s). Formulations for preparing magnetic recording layers are also well known in the art, as described for example, in Research Disclosure, publication 34390, November, 1992, U.S. Pat. No. 5,395,743 (Brick et al.), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding, or laminating.

Various supports can be used for such color negative films processed according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanedimethylene terephthalate, polyethylene 1,2-diphenoxyethane4,4'-dicarboxylate and poly (butylene terephthalate) are preferred. These materials can be subbed or unsubbed and coated with various antihalation, antistatic, or other non-imaging layers as is known in the art. Particularly useful antistatic layers on the backside of the materials include vanadium pentoxide in a suitable binder.

Representative photographic materials that can be processed to advantage using the present invention include, but are not limited to, KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

Reagents for color development compositions are well known, and described, for example, in Research Disclosure (noted above), sections XVIII and XIX, and the many references described therein. Thus, besides a color developing agent (such as a p-aminophenol or p-phenylenediamine), the color developers can include one or more buffers, antioxidants (or preservatives, such as sulfo-, carboxy, and hydroxy-substituted mono- and dialkylhydroxylamines), antifoggants, fragrances, solubilizing agents, brighteners, halides, sequestering agents, and other conventional addenda. Representative teaching about color developing compositions can also be found in U.S. Pat. No. 4,170,478 (Case et al.), U.S. Pat. No. 4,264,716 (Vincent et al.), U.S. Pat. No. 4,482,626 (Twist et al.), U.S. Pat. No. 4,892,804 (Vincent et al.), U.S. Pat. No. 5,491,050 (Brust et al.), U.S. Pat. No. 5,709,982 (Marrese et al.), U.S. Pat. No. 6,037,111 (Haye et al.), U.S. Pat. No. 6,017,687 (Darmon et al.), U.S. Pat. No. 6,077,651 (Darmon et al.), and U.S. Ser. No. 09/706,474 (filed Nov. 3, 2000 by Arcus et al.), all incorporated herein by reference.

A preferred photographic color developing composition has a pH of from about 9.5 to about 13 and comprises 4-(N-ethyl-N-β-hydroxyethylamino)-2-methylaniline sulfate (KODAK CD-4 Color Developing Agent), bromide ions, sulfite ions, and a carbonate buffer.

A particularly useful photographic bleach-fixing composition has a pH of from about 2 to about 9 and comprises ferric-ethylenediaminetetraacetic acid as the bleaching agent, ammonium thiosulfate as the fixing agent, sulfite ions, and phthalic acid or a salt thereof as described above.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al.), U.S. Pat. No. 5,441,852 (Hagiwara et al.), U.S. Pat. No. 5,529,890 (McGuckin et al.), U.S. Pat. No. 5,534,396 (McGuckin et al.), U.S. Pat. No. 5,578,432 (McGuckin et al.), U.S. Pat. No. 5,645,980 (McGuckin et al.), and U.S. Pat. No. 5,716,765 (McGuckin et al.), all incorporated herein by reference.

The photographic bleach-fixing composition of this invention can be provided in any suitable container, and can also be included in a processing kit with one or more other processing compositions in suitable containers.

The following examples are provided to illustrate the practice of the present invention and are not meant to be limiting in any way.

EXAMPLES 1 AND 2

Stabilized Photographic Bleach-Fixing Compositions

Two photographic bleach-fixing compositions of this invention were formulated as shown in TABLE II below. Both compositions were odorless.

The Example 2 composition was evaluated for storage stability for over five weeks. The aqueous composition was stored in an open glass container at room temperature. Any decrease in volume from evaporation was compensated for by periodically adding deionized water. The composition was analyzed after 5 weeks for the amounts of remaining thiosulfate, sulfite ion, and ferric ions. The results are shown in TABLE III below. They indicate that the bleach-fixing compositions of this invention have storage stability.

TABLE II

| COMPONENT | EXAMPLE 1 (mol/l) | EXAMPLE 2 (mol/l) |
|---|---|---|
| 1,3-Diaminopropane-tetraacetic acid | 0.262 | 0 |
| Succinic acid | 0.217 | 0 |
| Ferric nitrate, 9 hydrate | 0.238 | 0 |
| Ammonium thiosulfate | 1.307 | 0.486 |
| Ammonium sulfite | 0.117 | 0.044 |
| Sodium metabisulfite | 0.02 | 0.105 |
| Potassium hydrogen phthalate | 0.049 | 0.17 |
| EDTA | 0 | 0.013 |
| Ferric ammonium EDTA | 0 | 0.13 |
| pH (adjusted with ammonium hydroxide) | 3.93 | 4.5 |

TABLE III

| TIME (weeks) | Thiosulfate(%) Example 2 | Sulfite(%) Example 2 | % $Fe^{+3}$ Example 2 |
|---|---|---|---|
| 0 | 100 | 100 | 100 |
| 5 | 100 | 100 | 100 |

EXAMPLE 3

Photographic Processing Using "Merged Solution" Method

A sample of KODAK Max Zoom Color Negative Film was imagewise exposed to a 21-step chart and processed using the following processing compositions and conditions. This example illustrates the use of combined color developing/bleach-fixing compositions.

The imagewise exposed color negative film sample was placed in a cylindrical film processing canister, and 250 ml of Color Developing Composition A (identified below) was added at 49° C. After 60 seconds of color development, 342 ml of the bleach-fixing composition of Example 1 above was added all at once to the processing canister with rapid mixing at 49° C. After 120 seconds in the color developing/bleach-fixing composition, the processed film sample was then washed for 120 seconds with water and dried to obtain the desired color image.

| Color Developing Composition A: | |
|---|---|
| Sodium sulfite | 6.0 g/l |
| Sodium bromide | 2.1 g/l |
| Sodium carbonate, monohydrate | 31.5 g/l |
| 4-Amino-3-methyl-N-ethyl-(2-hydroxyethyl)aniline sulfate, | 6.75 g/l |
| pH (adjusted with sulfuric acid or sodium hydroxide) | 10.1 |

EXAMPLES 4–6

Process RA-4 Processing Method

Samples of KODAK Edge 8 Color Paper were given a step wedge test object exposure at 1/10 sec with HA-50, NP-11 filters, and 0.3 lnconel on a conventional 1B sensitometer. The samples were then processed using conventional EKTACOLOR Process RA-4 solutions and conditions except as noted as follows:

Color paper Sample A was color developed only (Comparison A) using EKTACOLOR Color Developer, color paper Sample B was color developed and bleach-fixed using conventional EKTACOLOR RA-4 solutions (Comparison B) and color paper samples C, D, and E were similarly processed except that bleach-fixing was carried out using compositions similar to that described in Example 1 above (except that they were at pH 4.5, 5.5, or 6.5 respectively) (Examples 4–6). Processing of all samples was carried out at 35° C. After processing, all samples were air-dried and the residual silver (g/m$^2$) of the samples was determined by X-ray fluorescence as tabulated in TABLE IV.

TABLE IV

| | Comparison | Comparison | Invention | | |
|---|---|---|---|---|---|
| Step Number | A (g/m$^2$) | B (g/m$^2$) | Example 4 (g/m$^2$) | Example 5 (g/m$^2$) | Example 6 (g/m$^2$) |
| 1 | 0.51 | 0.01 | 0.01 | 0.01 | 0.00 |
| 3 | 0.50 | 0.01 | 0.01 | 0.00 | 0.01 |
| 5 | 0.52 | 0.01 | 0.01 | 0.01 | 0.00 |
| 11 | 0.52 | 0.01 | 0.00 | 0.00 | 0.00 |
| 17 | 0.54 | 0.03 | 0.02 | 0.03 | 0.01 |
| 19 | 0.52 | 0.03 | 0.02 | 0.02 | 0.02 |
| 21 | 0.52 | 0.02 | 0.01 | 0.02 | 0.02 |

Bleach-fixing was considered complete when the residual silver level was less than 0.05 g/m$^2$. The data in Table IV show that all three phthalate bleach-fixing solutions of the present invention were useful to remove silver from the color paper samples to provide the desired color images. No odor was detected from the Example 4–6 compositions whereas Comparison B exhibited the usual objectionable odor.

EXAMPLES 7–8

Effect of Phthalate Concentration in Bleach-Fixing Composition

Samples of KODAK Edge 8 Color Paper were given a step wedge test object exposure and processed using the standard EKTACOLOR Process RA-4 conditions and protocol as described in Examples 4–6 except that the bleach-fixing compositions were similar to that of Example 2. The concentration of potassium hydrogen phthalate (KHP) was varied in the compositions as shown in TABLE V below. Both bleach-fixing compositions were odorless. The processed color paper samples were then washed for 120 seconds with water and dried. The residual silver (g/m$^2$) of the color paper samples was determined by X-ray fluorescence and tabulated as shown in TABLE V below.

TABLE V

| Step Number | Example 7 (0.09 mol/l KHP) g Ag/m$^2$ | Example 8 (0.25 mol/l KHP) g Ag/m$^2$ |
|---|---|---|
| 1 | 0.00 | 0.00 |
| 3 | 0.00 | 0.00 |
| 5 | 0.00 | 0.00 |
| 11 | 0.00 | 0.01 |
| 17 | 0.01 | 0.01 |
| 19 | 0.02 | 0.01 |
| 21 | 0.00 | 0.02 |

The data in TABLE V show that bleach-fixing compositions containing 0.09 and 0.25 mol/l of potassium hydrogen phthalate were effective in removing the silver from the color paper samples to provide the desired color images.

The invention has been described in detail with particular reference to certain preferred embodiments thereof, but it will be understood that variations and modifications can be effected within the spirit and scope of the invention.

We claim:

1. A photographic bleach-fixing composition that has a pH of from about 2 to about 9 when in aqueous form, and comprising:

at least 0.01 mol/l of a ferric-ligand bleaching agent, at least 0.05 mol/l of a thiosulfate fixing agent, at least 0.01 mol/l of sulfite ions, and at least 0.025 mol/l of a phthalic acid or a salt thereof.

2. The bleach-fixing composition of claim 1 that is in aqueous form and has a pH of from about 4.5 to about 8.

3. The bleach-fixing composition of claim 1 comprising phthalic acid, sodium hydrogen phthalate, potassium hydrogen phthalate, ammonium hydrogen phthalate, lithium hydrogen phthalate, sodium phthalate, and potassium phthalate sodium hydrogen phthalate, potassium hydrogen phthalate, or mixtures of two or more of these compounds.

4. The bleach-fixing composition of claim 3 comprising sodium hydrogen phthalate or potassium hydrogen phthalate.

5. The bleach-fixing composition of claim 1 wherein said ferric-ligand bleaching agent is present in an amount of from about 0.01 to about 2 mol/l, said thiosulfate fixing agent is present in an amount of from about 0.05 to about 5 mol/l, and said sulfite ions are present in an amount of from about 0.01 to about 1 mol/l.

6. The bleach-fixing composition of claim 1 wherein said phthalic acid or a salt thereof is present in an amount of from about 0.025 to about 1 mol/l.

7. The bleach-fixing composition of claim 1 wherein said ferric-ligand bleaching agent is present in an amount of from about 0.05 to about 0.75 mol/l, said thiosulfate fixing agent is present in an amount of from about 0.1 to about 4 mol/l, said sulfite ions are present in an amount of from about 0.05 to about 0.5 mol/l, and said phthalic acid or a salt thereof is present in an amount of from about 0.025 to about 0.75 mol/l.

8. The bleach-fixing composition of claim 1 further comprising succinic acid.

9. The bleach-fixing composition wherein said ferric-ligand complex is an iron complex of an aminopolycarboxylic acid or a polyaminopolycarboxylic acid.

10. The bleach-fixing composition of claim 9 wherein said ferric-ligand complex is biodegradable.

11. An aqueous bleach-fixing composition having a pH of from about 4.5 to about 8 and comprising:

from about 0.05 to about 0.75 mol/l of a ferric-ligand complex bleaching agent, from about 0.1 to about 4 mol/l of ammonium thiosulfate fixing agent, from about 0.05 to about 0.5 mol/l of sulfite ions, and from about 0.025 to about 0.75 mol/l of sodium hydrogen phthalate, potassium hydrogen phthalate, or a mixture thereof.

12. A method for providing a color photographic image comprising contacting a color developed color photographic silver halide material with a photographic bleach-fixing composition that has a pH of from about 2 to about 9 when in aqueous form and comprises:

at least 0.01 mol/l of a ferric-ligand bleaching agent, at least 0.05 mol/l of a thiosulfate fixing agent, at least 0.01 mol/l of sulfite ions, and at least 0.025 mol/l of a phthalic acid or a salt thereof.

13. The method of claim 12 further comprising rinsing or stabilizing said color developed color photographic silver halide material.

14. The method of claim 12 wherein said color photographic silver halide material is a color photographic paper.

15. A method for providing a color photographic image comprising:

A) color developing an imagewise exposed color photographic silver halide material in a predetermined volume of an aqueous color developing composition in a processing chamber, and B) without removing said predetermined volume of said aqueous color developing composition or said color photographic silver halide material from said processing chamber, adding a predetermined volume of a photographic bleach-fixing composition to said processing chamber to provide a combined aqueous color development/bleach/fixing composition, and bleaching and fixing said color photographic silver halide material, said photographic bleach-fixing composition having a pH of from about 2 to about 9 when in aqueous form and comprising:

at least 0.01 mol/l of a ferric-ligand bleaching agent, at least 0.05 mol/l of a thiosulfate fixing agent, at least 0.01 mol/l of sulfite ions, and at least 0.025 mol/l of a phthalic acid or a salt thereof.

16. The method of claim 15 wherein said predetermined volume of said color developing composition is from about 50 to 2850 ml/m$^2$ of surface area of processed color photographic silver halide material, and said predetermined volume of said bleach-fixing composition introduced into the processing chamber is sufficient to provide an additional volume of from about 6 to about 4000 ml/m$^2$ of surface area of processed color photographic silver halide material.

17. The method of claim 16 wherein said predetermined volume of said color developing composition is from about 140 to about 1170 ml/m$^2$ of surface area of processed color photographic silver halide material, and the predetermined volume of said bleach-fixing composition is from about 20 to about 1600 ml/m$^2$ of surface area of processed color photographic silver halide material.

18. The method of claim 15 wherein said color photographic silver halide material is a color photographic paper or color negative film.

19. The method of claim 15 wherein said aqueous bleach-fixing composition has a pH of from about 4.5 to about 8 and comprises:

from about 0.05 to about 0.75 mol/l of a ferric-ligand bleaching agent, from about 0.1 to about 4 mol/l of ammonium thiosulfate fixing agent, from about 0.05 to about 0.5 mol/l of sulfite ions, and from about 0.025 to about 0.75 mol/l of sodium hydrogen phthalate, potassium hydrogen phthalate, or a mixture thereof.

20. The method of claim 15 wherein steps A and B are individually carried out at a temperature of from about 20 to about 65° C., and step A is carried out for from about 15 to about 360 seconds, and step B is carried out for from about 5 to about 360 seconds.

21. The method of claim 20 wherein steps A and B are individually carried out at a temperature of from about 30 to about 60° C., and step A is carried out for from about 25 to about 195 seconds and step B is carried out for from about 10 to about 360 seconds.

22. The method of claim 15 further comprising an acid or acid-fixer stop step between steps A and B, and said acid stop or acid-fixer step is carried out for from about 5 to about 60 seconds.

* * * * *

UNITED STATES PATENT AND TRADEMARK OFFICE

CERTIFICATE OF CORRECTION

PATENT NO. : 6,727,051 B2
APPLICATION NO. : 10/400607
DATED : April 27, 2004
INVENTOR(S) : Shirleyanne E. Haye et al.

It is certified that error appears in the above-identified patent and that said Letters Patent is hereby corrected as shown below:

Col. 13, Claim 9, line 1 -- The bleach-fixing composition <u>of claim 1</u> wherein said ferric-ligand complex is an iron complex of an aminopolycarboxylic acid or a polyaminopolycarboxylic acid. --

Signed and Sealed this

Twenty-second Day of January, 2008

JON W. DUDAS
*Director of the United States Patent and Trademark Office*